United States Patent [19]

St. Louis

[11] Patent Number: 4,687,262

[45] Date of Patent: Aug. 18, 1987

[54] ANTI-TILT SYSTEM FOR APPLIANCES

[75] Inventor: Robert M. St. Louis, St. Leonard, Canada

[73] Assignee: Camco Inc., Mississauga, Canada

[21] Appl. No.: 908,244

[22] Filed: Sep. 17, 1986

[30] Foreign Application Priority Data

Nov. 29, 1985 [CA] Canada ..... 496577

[51] Int. Cl.[4] ..... A47B 97/00

[52] U.S. Cl. ..... 312/276; 312/319

[58] Field of Search ..... 312/275, 276, 311, 319

[56] References Cited

U.S. PATENT DOCUMENTS

| | | | |
|---|---|---|---|
| 1,782,523 | 11/1930 | Warren | 312/311 |
| 3,150,904 | 9/1964 | Kendt et al. . | |
| 3,150,905 | 9/1964 | Payton et al. . | |
| 3,322,480 | 5/1967 | Barnstead et al. . | |
| 3,628,841 | 12/1971 | Sulcek | 312/311 |
| 3,738,727 | 6/1973 | Race et al. . | |
| 4,441,770 | 4/1984 | Brezosky . | |

FOREIGN PATENT DOCUMENTS

| | | |
|---|---|---|
| 836420 | 3/1970 | Canada . |
| 899437 | 5/1972 | Canada . |
| 1031406 | 5/1978 | Canada . |

*Primary Examiner*—Joseph Falk

*Attorney, Agent, or Firm*—Raymond A. Eckersley

[57] ABSTRACT

The cabinet of an appliance with a downwardly opening door is stabilized by a pair of legs each pivotally mounted to the cabinet on an axis fixed to the cabinet and oriental relative to the cabinet so that pivotal movement of each leg above its respective pivotal axis moves the foot of the leg forwardly and downwardly into a supporting position or movement of the door to closed position retracts the legs to their initial position.

7 Claims, 7 Drawing Figures

ANTI-TILT SYSTEM FOR APPLIANCES

FIELD OF THE INVENTION

The present invention relates to a cabinet support structure, more particularly the present invention relates to extendable stabilizing legs pivoted to the cabinet of the appliance and moveable around their respective pivots between retracted and extended operative positions

BACKGROUND OF THE INVENTION

In certain appliances wherein the door opens from a substantially vertical position to a substantially horizontal position by pivoting downward about a horizontal axis, i.e. the door being hinged at the bottom edge. The weight of the door and those elements on it may tend to tilt the appliance about its front supporting elements. For example, in the portable dishwashers which are normally provided with a front opening access door pivotable for a substantially horizontal axis so that the door moves from a vertical or upright position to a substantially horizontal lowered position. The cantilever extension of the door provides a lever to which any downward motion will tend to pivot the whole cabinet about its front support which will normally be a pair of casters thereby lift the rear of the cabinet. Obviously such an unstable structure may well result an accidental tilting of the appliance which in turn may result in damages to the contents thereof or possible injury to the person applying the force to the door to cause tilting.

This problem has been recognized by the art and various solutions have been proposed.

U.S. Pat. No. 3,150,904, issued Sept. 29, 1964 to Kendt et al discloses an anti-tipping device wherein bars are mounted adjacent each side edge of the appliance cabinet and are connected to the door in a manner such an opening of the door causes forward projection of the bars beyond the front of the cabinet to provide a foot to aid in supporting the cabinet and prevent tilting.

U.S. Pat. No. 3,150,905, issued Sept. 29, 1964 to Payton et al discloses an alternative form of anti-tip device wherein a pair of front panels position one on each side of the machine and normally located in face-to-face relationship with the front face of the machine are pivoted about substantially vertical axis to move the panels to a position substantially perpendicular to the front faces of the machine so that the free ends of the panels extend beyond the front face of the machine and provide an extended foot member. With this device it will be apparent there is very significant clearance between the free end of a panel (i.e. the foot member) and the floor so that an initial tipping must take place before the device becomes operative.

U.S. Pat. No. 3,322,480, issued May 30, 1967 to Barnstead et al, teaches the use of a relatively complicated linkage that lowers and extends a foot along a track as the door is moved to an open position.

Canadian Pat. No. 1,031,406, issued May 16, 1978 to Gurubatham (equivalent to U.S. Pat. No. 3,393,950) teaches a concept of a bottom front panel that is extendable from the front of the cabinet to a position underlying the open door when the door is open, so that face of the door bears against abuttments at the top of the panel to force abuttments of the bottom of the panel into contact with the floor and thereby stabilizes the cabinet.

Canadian Pat. No. 836,420, issued Mar. 10, 1970 to Dutcher et al (equivalent to U.S. Pat. No. 3,529,881) provides a device somewhat similar to the device shown in the above-mentioned Canadian Pat. No. 1,031,406. In this case the bottom panel is pivotally connected to the door by a pivot spaced from the hinged line of the door and is connected at its bottom end to the cabinet via a link so that movement of the door to open position causes the bottom panel to pivot into a position substantially perpendicular to the door along its pivot connection to the door and thereby provide a support spaced from the front of the cabinet and underlying the door when the door is in its open position.

U.S. Pat. No. 3,738,727 issued June 12, 1973 to Race et al discloses yet another extendable foot member for stabilizing a cabinet such as a dishwasher. In this particular arrangement interconnected links and levers coupled with a latching mechanism position the foot in operative position when the door is open and retract the foot to a retractive position when the door is closed. In this particular device, the leg member does not extend significantly beyond the front face of the cabinet and thus the effectiveness of the support is limited.

Canadian Pat. No. 899,437, issued May 2, 1972 to Kaldenberg provides support by a means of a pleated front panel, one end of which is connected to the cabinet at a position to spaced from the bottom of the door and the other end of which is connected to door adjacent to the top thereof with a pair of hinge points provided and so that a substantially vertical member extends downwardly from the door adjacent to the outer end thereof and forms a leg support when the door is open. Obviously this structure requires a particular type of paneling to form the decorative face of the door and thus severely limits the applicability.

U.S. Pat. No. 4,441,770 issued Apr. 10, 1984 to Brezosky teaches a device very similar to that taught in the above-referred to U.S. Patent 3,738,727.

It would be apparent to all of the above structures are relatively expensive to incorporate into the applicance, particularly in the dishwasher.

BRIEF DESCRIPTION OF THE PRESENT INVENTION

It is an object of the present invention to provide an anti-tilt structure which is relatively simple in that it requires only the use of a pair of substantially simple leg members that are pivotally connected to the cabinet and are simply turned about this pivot when moving between the extended operative position of the retracted inoperative position.

Broadly the present invention relates to an appliance having a cabinet with a front downwardly opening door pivotable on a substantially horizontal axis for movement between an elevated closed position and a lower open position, a pair of legs each terminating in a foot portion pivotally mounted one on each side of the longitudinal curtain line of the cabinet on a pivotal axis fixed relative to the cabinet and oriented relative to said cabinet so that pivotal movement of each of said legs on its respective pivotal axis moves its foot portion forwardly and downwardly relative to said cabinet to position said foot portion of each said leg in an extended floor engaging position and means interconnecting each of said legs with said door where by movement of said door and imparts movement to each of said legs to move same to extended position when said door is moved to its downward open position.

Normally the pivotal axis of each of the legs would be in a substantially vertical plane that preferably would be substantially parallel to said longitudinal axis. The pivotal axis will be at an acute angle to a vertical line.

Preferably separate cables will connect each of the legs to an adjacent portion of the door so that movement of the door moves the cables and thus the legs between the operative and inoperative positions. Generally the same cables will be used to connect to brackets with the two brackets so connected being themselves interconnected by springs so that opening of the door extends the springs and the springs serve to counter-balance the weight of the door.

With this counter-balancing mechanism, a simple link may be used to connect the end of each leg remote from and on the opposite side of the pivot axis of the leg from the foot portion with the adjacent of said brackets.

BRIEF DESCRIPTION OF THE DRAWINGS

Further features, objects and advantages will be evident from the following detailed description of the preferred embodiments of the present invention taken in conjunction with the accompanying in which.

DESCRIPTION OF THE PREFERRED EMBODIMENTS

Figure 1:
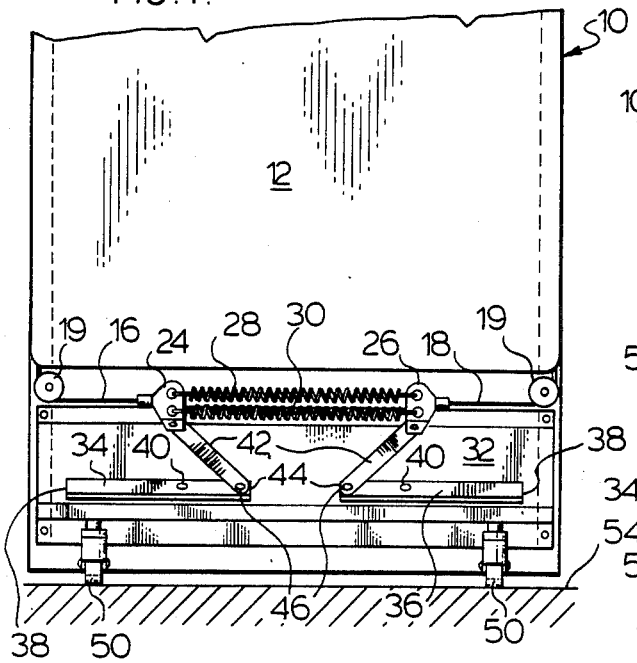
FIG. 1 is a partial front view with parts broken away schematically illustrating the present invention with the foot members in retracted position.
Figure 2:
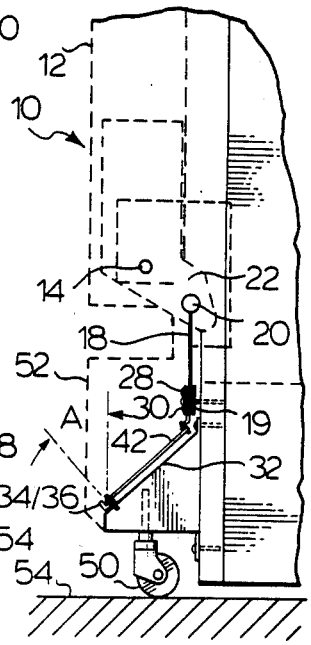
FIG. 2 is a partial side elevation view with parts omitted schematically illustrating the structure of the 1.
Figure 3:
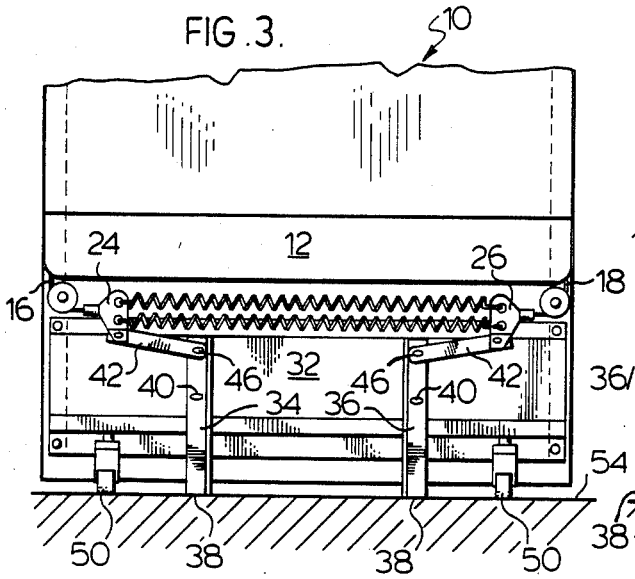
FIG. 3 is a view similar to FIG. 1 but showing the legs in extended operative position.
Figure 4:
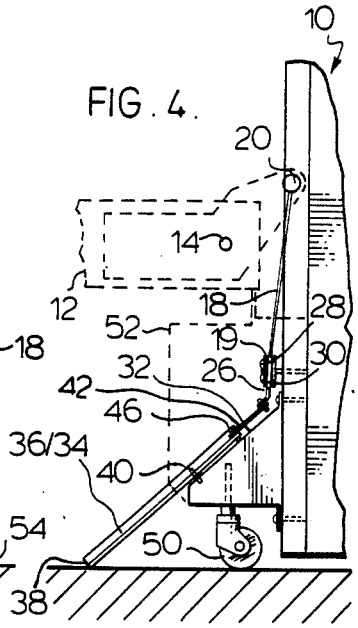
FIG. 4 is a side elevation similar to FIG. 2 but showing the door in open position and the support legs

In FIGS. 1 and 2, the appliance generally indicated at 10 to provide with a door 12 pivotally mounted on the front of the appliance cabinet 10 on pivot 14 there being one pivot 14 at each end of the door. In the arrangement illustrated a pair of cables 16 and 18 are connected to pins 20 mounted on arms 22 (only one shown) which are fixed to and pivot with the door 12 so that movement of the door 12 from its closed position illustrated in FIGS. 1 and 2 to its open position as illustrated in FIGS. 3 and 4 moves the end of the cables 16 and 18 connected to the pins 20 vertically upward.

Connected to the opposite ends of the cables 16 and 18 are a pair of brackets 24 and 26 which in turn are connected to a pair of tensions springs 28 and 30. Movement of the end of the cables 16 and 18 connected the pins 20 upward causes the opposite ends of the cables 16 and 18 to separate thereby separating the brackets 24 and 26 and stretching the springs 28 and 30 as shown in FIG. 3.

Pivotally mounted on a suitable incline panel 32 located at the front of the cabinet and immediately below the door 12 are a pair of legs 34 and 36, each having a foot portion 38 and each of which is pivoted to panel 32 on its respective pivot pin 40. Each of the pivot pins 40 preferably extend in a substantially vertical plane and at an acute angle A to the vertical (see FIGS. 2 and 5). A pair of links 42 connect the ends 44 of the legs 34 and 36 remote from foot portion 38 to the brackets 24 and 26 respectively. These links 42 are pivotally connected to the legs 34 and 36 by pivoted pins 46 and to the brackets 24 and 26 by a suitable pivoted pins 48 (only one shown, see FIG. 5).

Figure 5:
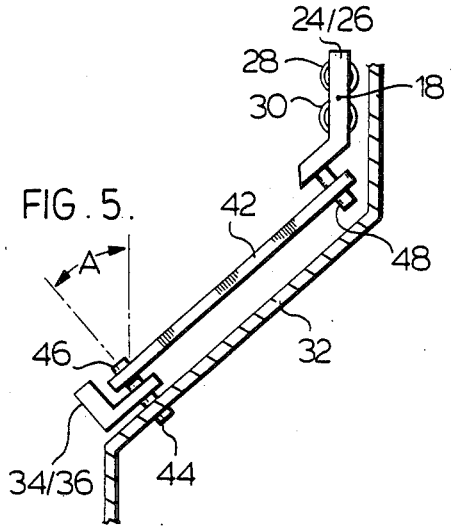
FIG. 5 is a slightly enlarged view illustrating the link the bracket to the foot with the retract position.

It will be apparent from FIG. 5 that all of the pivot pins, namely pivot pins 40, 46 and 48 preferably are substantially parallel and extend substantially perpendicular to the upper face of the panel 32.

The whole unit is supported for mobility on casters as indicated at 50 so that the unit or appliance cabinet may be moved about the house to the desired location as is normally the case for example when the particular appliance involved as a portable dishwasher.

The angle A may be in a suitable angle, as illustrated, an acute angle of about 45° to the vertical plane, however, the particlar angle selected will determine the amount that the legs 34 and 36 project in front of the cabinet when they are in an extended position.

It will be noted that the whole mechanism for providing stability, particularly in a unit utilizing the equivalent of cables 16 and 18 and springs 28 and 30 for biasing the door to closed position is mounted below the door and is relatively simple and consists only a pair of links and a pair of legs suitably interconnected with the legs pivoted to the frame of the cabinet.

When the door 12 is in closed position, each of the cables 16 and 18 extends around its respective pulley 19, positioned one at each side of the appliance, the springs 28 and 30 are still under slight tension to maintain tension in the cables 16 and 18 and the legs 34 and 36 are retracted i.e. the foot portions 38 are within the body of appliance and preferably will be hidden behind a panel such as the panel shown in dotted lines at 52 in FIGS. 2 and 4, i.e. the brackets 24 and 26 are relatively close together as are the ends 44 of the legs 34 and 36.

When the door is open, the ends of each of the cables 16 and 18 connected to the pin 20 are moved upwardly so that the portions extending around pulleys 19 move toward the outside of the cabinet, i.e. bracket 24 is moved to the left and the bracket 26 is moved to the right in the arrangement shown in FIG. 1 into the position as shown in FIG. 3. In the later position the legs 34 and 36 extend in a vertical plane substantially perpendicular to the front edge of the cabinet and downwardly so that the leg portion 38 will contact the floor as schematically indicated at 54 (see FIGS. 3 and 4).

It will be noted that in this position the forces applied to the stabilizing legs 34 and 36 that tends to place the pivot pins 40 under tension and to apply a bending movement to the leg members 34 and 36 tend to force the ends 44 remote from the foot portions 38 into contact with the face of the panel 32. In other words, the forces applied to the leg members 34 and 36 when in an operative position do not tend to force leg members back to inoperative position but in fact act in a direction substantially perpendicular to the forces normally necessary to retract the legs thereby ensuring the legs are not accidentally by the force of the tilting action moved to a retracted position permitting the appliance to be tilted.

It will be apparent that while the links 42 in the arrangement shown connect the brackets 24, 26 to their adjacent legs 34, 36 respectively, the links 42 could be arranged to cross so that the links from bracket 24 would connect to leg 36 and from bracket 26 to leg 34. In this case the foot portions 38 of the legs 34 and 36 when in retracted position would be adjacent one another and the legs would pivot about their pivots in the opposite direction to that illustrated in FIGS. 1 and 3.

Figure 6:
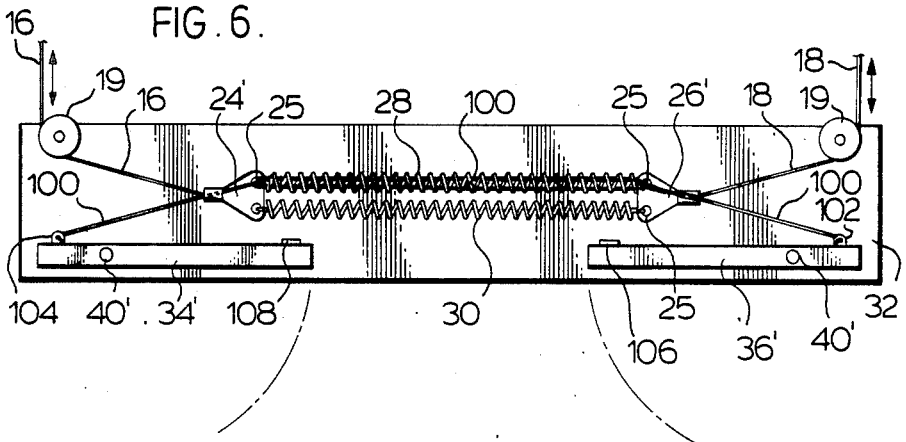
FIG. 6 is a partial view similar to FIG. 1 with parts omitted illustrating another arrangement for the feet.
Figure 7:
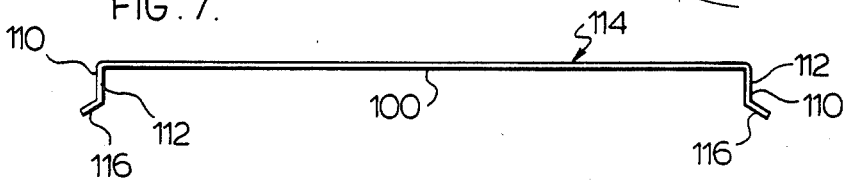
FIG. 7 is an illustration of a spring wire link used to connect each leg to the spring bracket.

In the arrangement shown in FIGS. 6 and 7 the structure including the pullies 19, cables 16 and 18, and the pair of springs 28 and 30 and the support panel 32 are essentially the same as in the previous described embodiments.

The brackets 24' and 26' are slightly modified relative to the brackets 24, 26 of the FIGS. 1 to 5 embodiment and are substantially flat plates provided simply with holes in 25 into which the curve end of the springs 28 and 30 are inserted to secure these springs 28 and 30 to the brackets 24' and 26'.

In the FIGS. 6 and 7 embodiment, a pair of spring wires 100 is provided with one of the spring wires 100 connected to and extending from the bracket 24' through the coil spring 28 and connected to the foot member 36 via a suitable tab or bracket 102. The tab 102 is located on the opposite side of the pivot pin 40' on which the foot member 36' pivots relative to the floor contacting end of the leg 36'. The end of the resilient wire member 100 connected to the bracket 24' is curved and passes through the aperture 25 into which one end of the spring 28 is received thereby to connect the spring wire 100 to the bracket 24'.

The other wire 100 of the pair of wires also extends through the spring 28 and is connected at one end to the bracket 26' and at the opposite end to the tab or bracket 104 on the leg member 34' in the same manner as the previously described wire 100 was connected to the brackets 24' and 102.

Suitable stop members 106 and 108 project from the support panel 32 and limit further movement of the legs 34' and 36' about their respective pivots 40' when these legs are moved into their retracted position as shown in FIG. 6.

A spring wire 100 is illustrated in FIG. 7. Both of the spring wires 100 will be essentially the same and each is provided adjacent to each end with an end section 110 adapted to be received either in an aperture 25 or in the aperature in bracket 102 or 104. These end sections 110 in turn are each formed by a substantially perpendicular portion 112 extending substantially perpendicular to the main section 114 of the wire 100 and a flared section 116 extending from the free end of the perpendicular portion 112.

Preferably the spring wires 100 will be made longer than the distance between the brackets 24' and 102 or 26' and 104 respectively to force the and 106 in rest position. The extra length simply forces a slight bend in the wire 100 as shown but raise no problem in function.

Passing the wires 100 through the coil spring 28 limits the bow of the spring wires 100 and permits the use of smaller spring wire. Obviously the wires 100 could alternatively pass through the other spring 30 or if different length of wires 100 were used, one could pass through each of the springs 28 and 30.

It will be apparent that as the door to the appliance (dishwasher) opens brackets 24' and 26' move apart thereby moving brackets 102 and 104 on leg members 34' and 36' towards the center in the machine thereby pivoting the opposite ends of the leg members 34' and 36' to an extended position as described hereinabove with respect to the other embodiments.

Having described the invention, modification will be evident to those skilled in the art without departing from the spirit of the invention as defined in the appended claims.

What I claim as new and desire to secure by Letters Patent of the United States is:

1. An appliance comprising:

a cabinet adapted to be supported on a floor including a bottom end and a front downardly opening door pivotally mounted adjacent to the bottom end for pivoting on a substantially horizontal axis between an elevated closed position and a lowered open position, said cabinet having a longitudinal center line;

a pair of legs each terminating at one end in a foot portion, each leg of said pair of legs being pivotally mounted, one on each side of the longitudinal center line, on a pivotal axis fixed relative to and oriented relative to said cabinet, each leg of said pair of legs being pivotally movable around the pivotal axis between a first retracted position and a second floor engage position located downwardly and forwardly of the first position where the foot portion of each leg engages the floor to further support said cabinet; and, connecting means for connecting each of said legs with said door comprising a pair of cables connected one to each side of said door, a pair of brackets being interconnected by tension spring means, each of said pair of brackets being connected to one of the pair of cables and one of the pair of legs adjacent the pivotal axis such that when the door is moved from the closed position to the open position said cables move said brackets in opposing directions away from each other to tension the spring means and to move each leg around the pivotal axis in a first angular direction thereby moving said pair of legs from the first retracted position into the second floor engage position and movement of said door from the open position to the closed position causes said brackets to move towards each other due to contraction of the spring means and to move each leg around the pivotal axis in a second angular direction opposite to the first angular direction thereby moving said pair of legs from the second floor engage postiion to the first retracted position.

2. An appliance as defined in claim 1 wherein said pivotal axes on which said legs are mounted are positioned in a plane that extends at an acute angle to a vertical plane.

3. An appliance as defined in claim 1 wherein said connecting means further comprises a first link connecting one said brackets to an adjacent one of said legs and a second link connecting the other of said brackets to the other of said legs.

4. An appliance as defined in claim 1 wherein said connecting means further comprises a first spring wire connecting one of said brackets to one of said legs remote from said one of said brackets and a second spring wire connecting the other of said brackets to the other of said legs.

5. An appliance as defined in claim 4 wherein said spring means comprise a coil spring and wherein said first and said second spring wires extend longitudinally through the center of the coil formed by said coil spring.

6. An appliance as defined in claim 5, wherein each of said first and second spring wires has a length measured between its points of connection to its respective said bracket and its connection to its respective said leg that is longer than the distance between said points of connection for each said spring wire so that each said spring wire is bowed.

7. An appliance as defined in claim 4 wherein each of said first and second spring wires has a length measured between its points of connection to its respective said bracket and its connection to its respective said leg that is longer than the distance between said points of connection for each said spring wire so that each said spring wire is bowed.

* * * * *